United States Patent [19]

Saleh

[11] 4,267,532

[45] May 12, 1981

[54] ADJUSTABLE MICROSTRIP AND STRIPLINE TUNERS

[75] Inventor: Adel A. M. Saleh, Holmdel, N.J.

[73] Assignee: W. L. Keefauver, Bell Laboratories, Murray Hill, N.J.

[21] Appl. No.: 83,591

[22] Filed: Oct. 11, 1979

[51] Int. Cl.[3] ..... H01P 5/00

[52] U.S. Cl. ..... 333/33; 333/246; 333/263

[58] Field of Search ..... 333/33, 223, 224, 225, 333/235, 263, 245, 246

[56] References Cited

U.S. PATENT DOCUMENTS

| | | | |
|---|---|---|---|
| 2,247,779 | 7/1941 | Keister | 333/235 X |
| 2,757,344 | 7/1956 | Kostriza et al. . | |
| 3,796,976 | 3/1974 | Heng et al. . | |
| 4,096,453 | 6/1978 | Rogers | 333/225 X |
| 4,121,182 | 10/1978 | Makimoto et al. . | |

*Primary Examiner*—Paul L. Gensler
*Attorney, Agent, or Firm*—Erwin W. Pfeifle

[57] ABSTRACT

The present invention relates to a class of adjustable microstrip and stripline tuners. An exemplary tuner comprises a pair of tuning elements, where each tuning element further comprises a pair of parallel spaced-apart conductive strips of equal length and at least one movable bridging wire connecting the two strips. The movement of the bridging wire will vary the output impedance of the tuning element, and a complementary arrangement of a pair of tuning elements will form a tuner capable of matching any impedance falling within the Smith chart.

2 Claims, 15 Drawing Figures

$10^1$
$10^2$
$(Z^1_{12})^2 / (Z^1_{12} + Z^1_{14})$
$(Z^3_{12})^2 / (Z^3_{12} + Z^3_{14})$
$(Z^4_{12})^2 / (Z^4_{12} + Z^4_{14})$
$(Z^6_{12})^2 / (Z^6_{12} + Z^6_{14})$
$\Phi_1$
$\theta_1$
$\Phi_2$
$\theta_2$
$\psi$
$Y_{12} + Y_{14}$
$Y^1_{12} + Y^1_{14}$
$Y^2_{12} + Y^2_{14}$
$Y^3_{12} + Y^3_{14}$
$Y^4_{12} + Y^4_{14}$
$Y^5_{12} + Y^5_{14}$
$Y^6_{12} + Y^6_{14}$
$\alpha_1$
$\alpha_2$
$30_1$
$31_2$
$30_3$
$30_4$
$31_5$
$30_6$
1
2

ADJUSTABLE MICROSTRIP AND STRIPLINE TUNERS

BACKGROUND OF THE INVENTION

1. Technical Field

The present invention relates to a class of strip transmission line circuits comprising adjustable microstrip and stripline tuners and, more particularly, to tuners which employ a pair of tuning elements in a complementary arrangement which can be used in combination to match any impedance falling within the Smith chart, each tuning element comprising a pair of adjacent, coupled or uncoupled, parallel conductive strips of equal length with one or two bridging wires, movable metallic blocks or sliding contacts bridging the gap between the strips.

2. Description of the Prior Art

Various microwave devices require the use of adjustable tuners in experimental evaluation of their performance. In the past, microstrip and stripline test fixtures were equipped with transitions to coaxial transmission lines and, therefore, coaxial-line multi-slug or multi-stub tuners could be employed. However, the large separation between the device and the tuner limited its use to frequencies less than 10 GHz. There is a need, therefore, for tuners that may be employed directly with the microstrip and stripline medium to overcome the frequency limitation of the coaxial-line tuners.

One type of tuner that is available for use with microwave transmission lines is disclosed in U.S. Pat. No. 2,757,344 issued to J. Kostriza et al on July 31, 1956, which relates to a tuner that comprises a first wide and a second narrow conductor mounted in parallel on opposite sides of a substrate. A coupling means is longitudinally movable between the adjacent conductors at a distance from the second conductor of the transmission line, and this coupling means forms, in conjunction with the first conductor of the transmission line directly adjacent the tuner, an adjustable resonant network.

The design of stripline filters and directional coupling arrangements are discussed in an article "Coupled-Strip-Transmission-Line Filters and Directional Couplers" by E. M. T. Jones et al. in *IRE Transactions on Microwave Theory and Techniques,* Vol. MTT-4, No. 2, April 1956 at pp 75–81. There, low-pass, band-pass, all-pass and all-stop basic filter characteristics are obtained from a pair of parallel, spaced-apart, strips either by placing open or short circuits at two of the four available terminal pairs, or by interconnecting two of the terminal pairs. The article further describes how desired performance may be achieved by cascading several of the basic filter sections.

Another design method for a class of stripline filters is discussed in the article "Synthesis of a Class of Strip-Line Filters" by H. Ozaki et al. in *IRE Transactions on Circuit Theory, Vol. CT*-5, No. 2, June 1958 at pp 104–109. The disclosed method relates to design on an insertion loss basis. Synthesis procedures are presented for the line type, low-pass ladder, high-pass ladder and band-pass ladder filter arrangements. The Ozaki et al. arrangements comprise line or ladder cascaded canonical filter sections with each section comprising a pair of parallel, spaced-apart, strips having either the same or different widths.

The problems remaining in the prior art is to provide a class of tuners which are capable of being formed directly on the microstrip or stripline medium and are also capable of matching any impedance falling within the Smith chart.

SUMMARY OF THE INVENTION

The problem remaining in the prior art has been solved in accordance with the present invention which relates to a class of strip transmission line circuits comprising adjustable microstrip and stripline tuners which employ a pair of tuning elements in a complementary arrangement which can be used in combination to match any impedance falling within the Smith chart, each tuning element comprising a pair of adjacent, coupled or uncoupled, parallel conductive strips of equal length with one or two bridging wires, movable metallic blocks or sliding contacts bridging the gap between the strips.

It is an aspect of the present invention to provide a class of microstrip and stripline tuners that can be formed directly on the substrate, and placed as close to the device being tested as desired without affecting the performance of either the device or the tuner.

Another aspect of the present invention is to provide a tuner which may be connected to the device either through one port to provide an adjustable shunt reactance or through two ports to provide an adjustable two-port reactive network for the device.

Other and further aspects of the present invention will become apparent during the course of the following description and by reference to the accompanying drawings.

BRIEF DESCRIPTION OF THE DRAWINGS

Referring now to the drawings in which like numerals represent like parts in several views.

DETAILED DESCRIPTION

Figure 1:
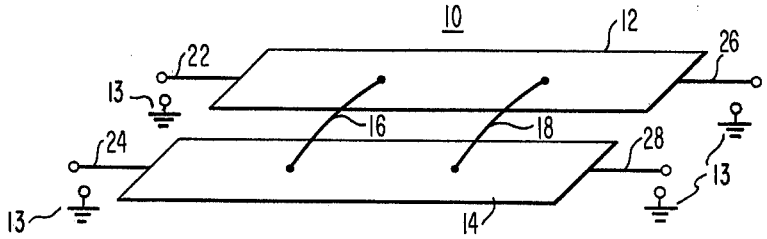
FIG. 1 is a view in perspective of an exemplary tuning element containing two bridging wires in accordance with the present invention.

FIG. 1 contains an exemplary single parallel-strip tuning element 10 comprising a pair of adjacent, parallel conductive strips of equal length 12 and 14 disposed above a ground plane 13, and a pair of bridging wires 16 and 18 connecting strip 12 to strip 14, bridging wires 16 and 18 being positioned in a manner such that bridging wire 18 is placed to the right of bridging wire 16. Tuning element 10 further comprises four ports 22, 24, 26 and 28, each port disposed at a separate end of strips 12 and 14. For example, ports 22 and 26 are disposed at the left and right ends, respectively, of strip 12 and ports 24 and 28 are disposed at the left and right ends, respectively, of strip 14.

Connecting a single port, e.g., port 22, of tuning element 10 to the device being tested (not shown) enables element 10 to perform as an adjustable single-port shunt reactance, the mobility of bridging wires 16 and 18 accounting for the adjustability of tuning element 10. An adjustable two-port reactive network can be obtained by connecting two ports of tuning element 10 to the device being tested. Each of the remaining unconnected ports of tuning element 10 may be open-circuited or short-circuited. The open circuit configurations are usually preferable because of the inconvenience of creating a short circuit in a microstrip or stripline medium, and because of the possible requirement of maintaining a bias voltage on the transmission line when active devices are involved.

Tuners formed in accordance with the present invention, in order to match any impedance falling within the Smith chart, comprise two tuning elements as shown generally in FIG. 1 and described hereinabove, arranged in a complementary manner as will be described in greater detail hereinafter in association with FIGS. 6, 9, 11 and 14. To enable analysis of the tuners formed in accordance with the present invention, FIGS. 2–5 illustrate two alternative known parallel strip circuit arrangements and their equivalent circuits which do not include bridging wires, blocks or sliding contacts.

Figure 2:
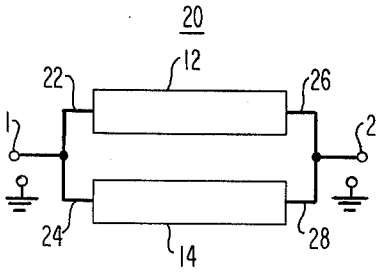
FIG. 2 (PRIOR ART)
FIGS. 2 and 4 illustrate two known alternative configurations of a parallel-strip circuit for use in analysis of various tuner arrangements formed in accordance with the present invention.

FIG. 2 illustrates a parallel-strip circuit 20 similar to tuning element 10 described hereinabove in association with FIG. 1. Parallel-strip circuit 20 comprises the conductive strips 12 and 14, and ports 22, 24, 26 and 28 associated with tuning element 10 of FIG. 1, but does not contain bridging wires 16 and 18, since wires 16 and 18 are unnecessary in the development of basic circuit configurations. In circuit 20, ports 22 and 24 are connected to form terminal 1 which is available for connection to a utilization circuit (not shown), as are ports 26 and 28 connected to form terminal 2 which is also available for connection to a utilization circuit (not shown).

Figure 3:
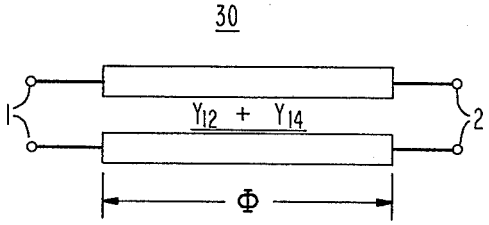
FIG. 3 (PRIOR ART)
FIGS. 3 and 5 illustrate the equivalent circuits of the known parallel-strip circuits associated with FIGS. 2 and 4, respectively, for use in analysis of various tuner arrangements formed in accordance with the present invention.

FIG. 3 illustrates the equivalent circuit 30 associated with parallel-strip circuit 20 of FIG. 2. In accordance with the well-known transmission line theory, the interconnection of ports 22 and 24 and the interconnection of ports 26 and 28, as described hereinabove in association with FIG. 2, creates transmission line equivalent circuit 30 as shown in FIG. 3. The admittance of strip 12 of FIG. 2 is defined as $Y_{12}$ and the admittance of strip 14 of FIG. 2 is defined as $Y_{14}$. The admittance of circuit 30, $Y_{12}+Y_{14}$, is obtained from the application of the well-known $4\times4$ admittance matrix of parallel-coupled lines, a detailed derivation of which is contained in the article "Even- and Odd-Mode Waves for Nonsymmetrical Coupled lines in Nonhomogeneous Media" by R. A. Speciale in *IEEE Transactions on Microwave Theory and Techniques*, Vol. MTT-23, No. 11, November 1975 at pp. 897–908. The distance $\Phi$, as shown in FIG. 3, is defined as the electrical length of the equivalent circuit 30. From transmission line theory, $\Phi$ is defined by the well-known relation $$\Phi=\omega l/v, \tag{1}$$

where $\omega$ is the angular frequency of the mode of propagation, l is the physical length of either strip 12 or 14 of parallel-strip circuit 20 of FIG. 2, strips 12 and 14 being of equal length, and v is the velocity of propagation of the mode of propagation.

Figure 4:
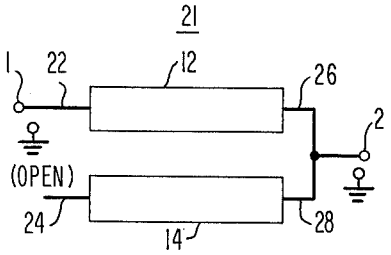
FIG. 4 (PRIOR ART)

FIG. 4 illustrates a parallel-strip circuit 21 which is a variant of parallel-strip circuit 20 of FIG. 2. In the case of parallel-strip circuit 21, no connection is provided between ports 22 and 24, port 22 forms terminal 1 which is available for connection to a utilization circuit (not shown), and port 24 is open-circuited. Like parallel-strip circuit 20 of FIG. 2, ports 26 and 28 of parallel-strip circuit 21 are interconnected to form terminal 2.

Figure 5:
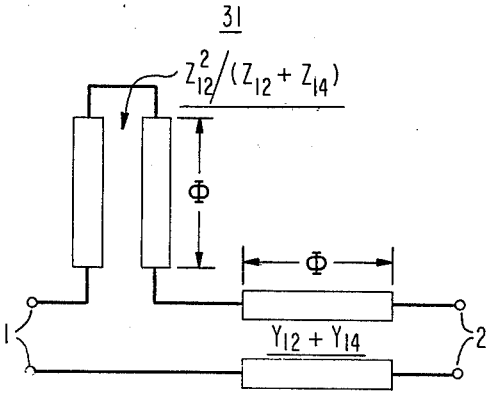
FIG. 5 (PRIOR ART)

FIG. 5 illustrates the equivalent circuit 31 associated with parallel-strip circuit 21 of FIG. 4. In accordance with the well-known transmission line theory, the interconnection of ports 26 and 28 and the open-circuit at port 24, as described hereinabove in association with FIG. 4, creates equivalent circuit 31 as shown in FIG. 5. The impedance of strip 12 of FIG. 4 is defined as $Z_{12}$ and the impedance of strip 14 is defined as $Z_{14}$. Further, the configuration of strips 12 and 14, in accordance with the present invention, yields the following relations:

$$Z_{12}=1/Y_{12},\ Z_{14}=1/Y_{14}, \tag{2}$$

where $Y_{12}$ and $Y_{14}$ are the admittances as described hereinabove in association with FIG. 3.

Equivalent circuit 31 comprises a series impedance formed by a short-circuited transmission line of characteristic impedance $Z_{12}^2/(Z_{12}+Z_{14})$ in cascade with another transmission line of characteristic admittance $Y_{12}+Y_{14}$. Both transmission lines have an electrical length $\Phi$, which may be obtained by employing equation (1).

Figure 6:
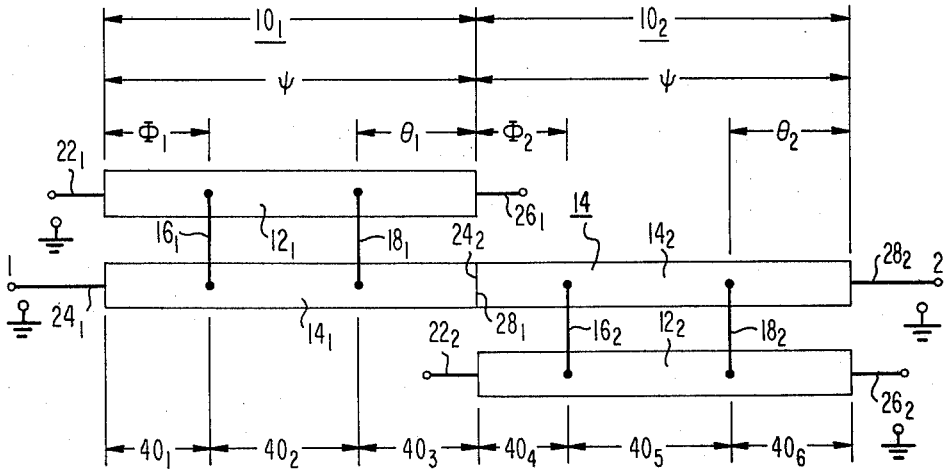
FIG. 6 illustrates a complete tuner in accordance with the present invention comprising two of the tuning elements of FIG. 1.

FIG. 6 illustrates an exemplary tuner formed in accordance with the present invention comprising two tuning elements $\mathbf{10_1}$ and $\mathbf{10_2}$, each tuning element being as described hereinabove in association with FIG. 1. Tuning elements $\mathbf{10_1}$ and $\mathbf{10_2}$ share the conductive strip 14, with the portion designated $\mathbf{14_1}$ being the half of strip 14 associated with tuning element $\mathbf{10_1}$ and the portion designated $\mathbf{14_2}$ being the half of strip 14 associated with tuning element $\mathbf{10_2}$. Strips $\mathbf{12_1}$ and $\mathbf{12_2}$ are positioned on opposite sides of, and parallel to, strip 14; strip $\mathbf{12_1}$ being associated with tuning element $\mathbf{10_1}$ and strip $\mathbf{12_2}$ being associated with tuning element $\mathbf{10_2}$. Bridging wires $\mathbf{16_1}$ and $\mathbf{18_1}$ interconnect strips $\mathbf{12_1}$ and $\mathbf{14_1}$, and in a like manner, bridging wires $\mathbf{16_2}$ and $\mathbf{18_2}$ interconnect strips $\mathbf{12_2}$ and $\mathbf{14_2}$.

The electrical lengths $\Phi_1$, $\theta_1$, $\Phi_2$, $\theta_2$ and $\psi$ can be obtained by using equation (1), where the length l of equation (1) is associated with each of the above-mentioned electrical lengths in the following manner: for $\Phi_1$, l is defined as the distance measured between port $\mathbf{22_1}$ and bridging wire $\mathbf{16_1}$; for $\theta_1$, l is defined as the distance measured between port $\mathbf{26_1}$ and bridging wire $\mathbf{18_1}$; for $\Phi_2$, l is defined as the distance measured between port $\mathbf{22_2}$ and bridging wire $\mathbf{16_2}$; for $\theta_2$, l is defined as the distance measured between port $\mathbf{26_2}$ and bridging wire $18_2$; and for $\psi$ l is defined as the entire length of either strip $12_1$ or $12_2$.

Each of tuning elements $10_1$ and $10_2$ is divided into three cascaded sections, tuning element $10_1$ comprising cascaded sections $40_1$, $40_2$ and $40_3$, and tuning element $10_2$ comprising cascaded sections $40_4$, $40_5$ and $40_6$. Each separate section may be analyzed by comparing the separate sections with parallel-strip circuits 20 and 21 of FIGS. 2 and 4, where the port interconnections of parallel-strip circuits 20 and 21 serve to perform in a like manner to bridging wires $16_1$, $18_1$, $16_2$, and $18_2$ of the tuner of FIG. 6. In the arrangement of FIG. 6, sections $40_1$ and $40_4$ can be seen to be similar to parallel-strip circuit 21 of FIG. 4 with one end of the parallel-strip sections $40_1$ and $40_4$ shorted by wires $16_1$ and $16_2$, respectively, sections $40_2$ and $40_5$ can be seen to be similar to parallel-strip circuit 20 of FIG. 2 with both ends of sections $40_2$ and $40_5$ short circuited by wires $16_1$ and $18_1$ and $16_2$ and $18_2$, respectively, and sections $40_3$ and $40_6$ can be seen to be similar to a mirror image of parallel-strip circuit 21 of FIG. 4 with one end of the sections $40_3$ and $40_6$ shorted with wires $18_1$ and $18_2$, respectively. The tuner arrangement of FIG. 6 can be seen to comprise six cascaded sections of parallel-strip circuits in accordance with FIGS. 2 and 4.

The tuner arrangements may, in turn, be analyzed by employing cascaded sections of equivalent circuits 30 and 31 of FIGS. 3 and 5, where equivalent circuits 30 and 31 are associated with parallel-strip circuits 20 and 21, respectively. This analysis is described in greater detail hereinafter in association with FIG. 7.

Figure 7:
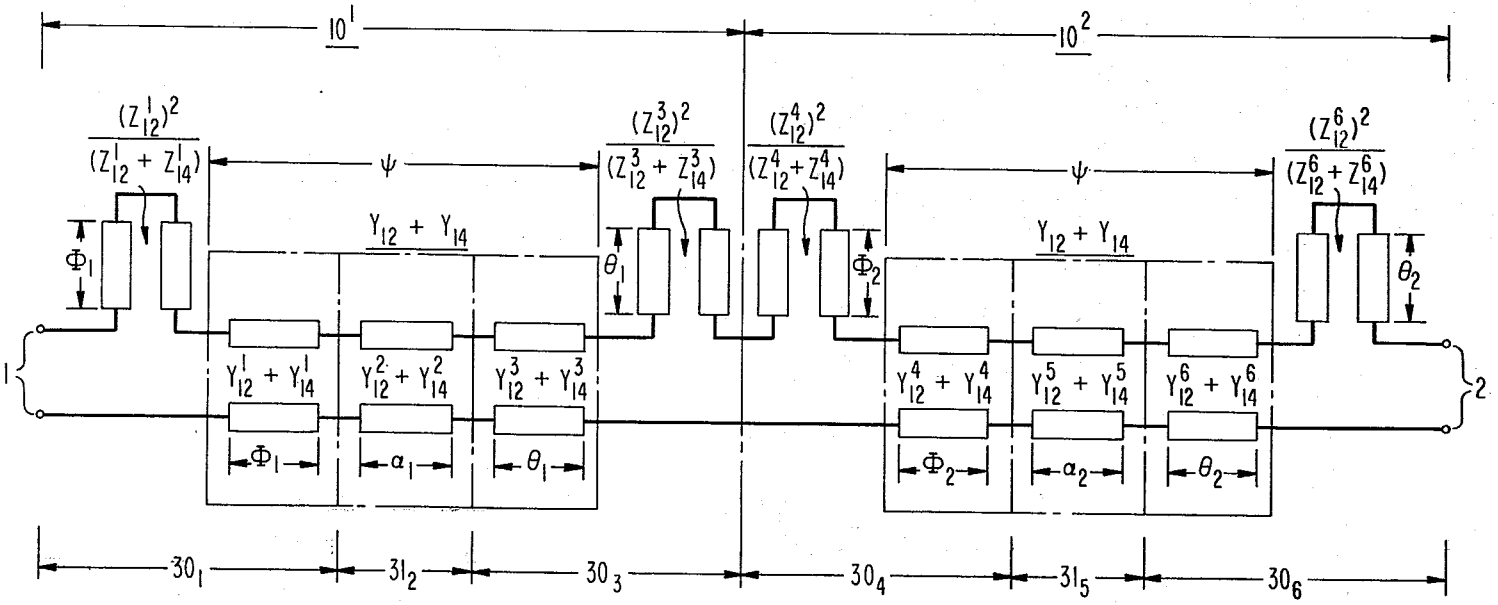
FIG. 7 illustrates an all-frequency equivalent circuit of the tuner of FIG. 6.

FIG. 7 illustrates an exemplary all-frequency equivalent circuit associated with the tuner of FIG. 6. As stated hereinabove in association with FIG. 6, FIG. 7 comprises cascaded sections of equivalent circuits 30 and 31 of FIGS. 3 and 5. Specifically, the overall equivalent circuit is divided into six cascaded sections, each separate section being of the form of equivalent circuit 30 or 31, as denoted by the numeral accompanying each section, and each separate section also being associated with its respective section of FIG. 6, as denoted by the subscript accompanying each numeral. For example, section $30_1$ of FIG. 7 is of the form of equivalent circuit 30 and is related to the first section, $40_1$, of the tuner of FIG. 6 between ports $22_1$ and $24_1$ and bridging wire $16_1$, and section $31_5$ of FIG. 7 is of the form of equivalent circuit 31 and is related to the fifth section, $40_5$, of the tuner of FIG. 6.

The impedance or admittance of each section of FIG. 7 can be related to the appropriate section of FIG. 6 in the following manner: $Z_{12}^1$ and $Y_{12}^1$ are associated with the portion of strip $12_1$ associated with section $40_1$, $Z_{14}^1$ and $Y_{14}^1$ are associated with the portion of strip $14_1$ associated with section $40_1$, $Z_{12}^2$ and $Y_{12}^2$ are associated with the portion of strip $12_1$ associated with section $40_2$, and continuing in a like manner such that $Z_{14}^6$ and $Y_{14}^6$ are associated with section $40_6$ of strip $14_2$.

The notation may be simplified by the following reductions:

$$Y_{12}^1=Y_{12}^2=Y_{12}^3=Y_{12}^4=Y_{12}^5=Y_{12}^6=Y_{12}. \quad (3)$$

$$Y_{14}^1=Y_{14}^2=Y_{14}^3=Y_{14}^4=Y_{14}^5=Y_{14}^6=Y_{14}. \quad (4)$$

The arrows shown on the series impedance sections of the equivalent circuit of FIG. 7 are to illustrate the variability of these elements caused by the variations in $\Phi_1$, $\theta_1$, $\Phi_2$ and $\theta_2$ due to the movement of bridging wires $16_1$, $18_1$, $16_2$ and $18_2$, respectively. Note that the overall lengths of the cascaded transmission line sections $\Phi_1+\alpha_1+\theta_1$ and $\Phi_2+\alpha_2+\theta_2$, each of which being equal to $\psi$, do not change, since $\psi$ is the electrical length of the entire tuning element, which cannot be varied. The variability of the equivalent circuit will be discussed in greater detail hereinafter in association with FIG. 8.

Figure 8:
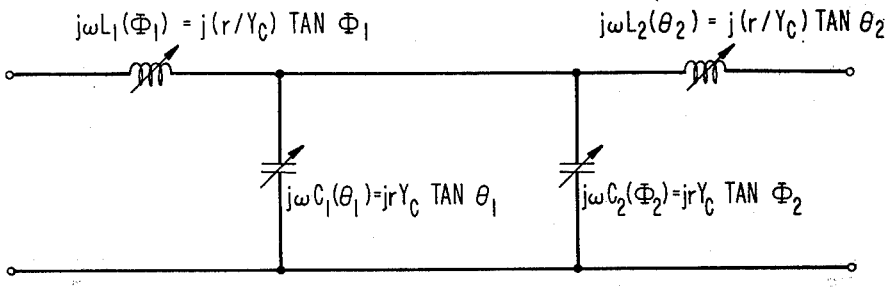
FIG. 8 illustrates a specific equivalent circuit of the tuner of FIG. 6 for the value of $\psi=\pi/2$.

FIG. 8 illustrates a specific equivalent circuit of the all-frequency equivalent circuit of FIG. 7 depicted for the value of $\psi=\pi/2$. The specific value of $\psi$ is chosen for illustrative purposes only and is not intended to limit the scope and spirit of the present invention. Using this value of $\psi$ in association with the relations $$r=Z_{14}Y_{12},\ Y_c=Y_{12}+Y_{14}, \quad (5)$$

where $Z_{12}=Z_{12}^1=Z_{12}^3=Z_{12}^4=Z_{12}^6$ in the present example if strips $12_1$ and $12_2$ are symmetric, in association with well-known definitions from transmission line theory, the equivalent circuit of FIG. 7 may be reduced to the specific equivalent circuit of FIG. 8. This specific circuit comprises four adjustable active elements, $L_1$, $L_2$, $C_1$ and $C_2$, where each element is defined as follows:

$$j\omega L_1(\Phi_1)=j(r/Y_c)\tan\Phi_1 \quad (5a)$$

$$j\omega C_1(\theta_1)=jrY_c\tan\theta_1 \quad (5b)$$

$$j\omega L_2(\theta_2)=j(r/Y_c)\tan\theta_2 \quad (5c)$$

$$j\omega C_2(\theta_2)=jrY_c\tan\theta_2 \quad (5d)$$

where $\omega$ is the angular frequency, and where each separate element is a function of one of the four electrical lengths $\Phi_1$, $\theta_1$, $\Phi_2$ or $\theta_2$.

It can be shown from well-known basic circuit theory techniques, that varying the values independently of $\Phi_1$, $\theta_1$, $\Phi_2$ and $\theta_2$ from 0 through $\pi/2$ by the movement of bridging wires $16_1$, $18_1$, $16_2$ and $18_2$, respectively will allow this equivalent circuit, and hence the tuner of FIG. 6, to be capable of matching any impedance falling within the Smith chart.

Figure 9:
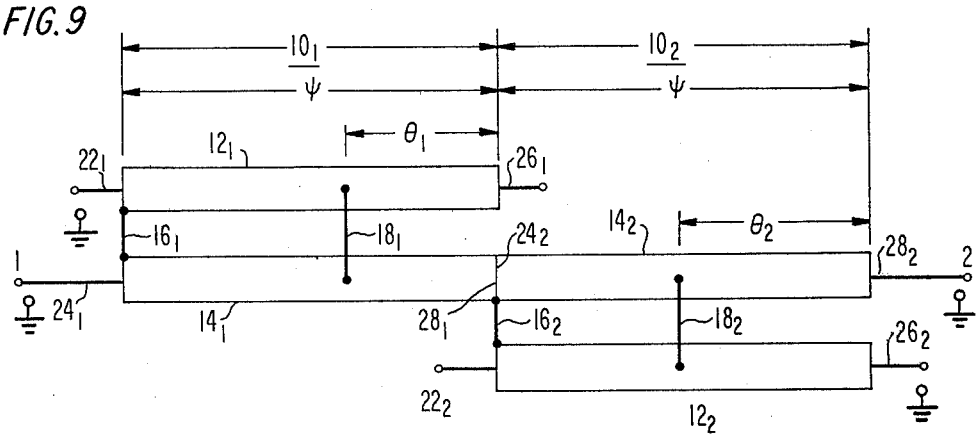
FIG. 9 illustrates a variant of the tuner of FIG. 6.

FIG. 9 illustrates a variant of the tuner of FIG. 6 where bridging wires $16_1$ and $16_2$ are positioned at the extreme left ends of tuning elements $10_1$ and $10_2$, respectively, thereby setting $\Phi_1=\Phi_2=0$. Therefore, under such conditions, only the movement of bridging wires $18_1$ and $18_2$ are capable of affecting the performance of the tuner.

Figure 10:
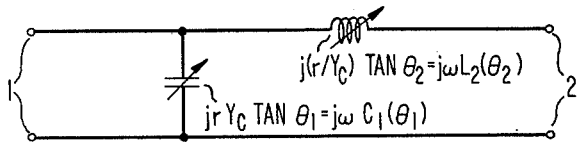
FIG. 10 illustrates a specific equivalent circuit of the tuner of FIG. 9 for the value of $\psi=\pi/2$.

FIG. 10 can be derived from FIG. 8, where in this case $jrY_c\tan\Phi_1=jwL_1=0$ and $jrY_c\tan\Phi_2=j\omega C_2=0$, since $\Phi_1=\Phi_2=0$ as shown hereinabove in association with FIG. 9. The equivalent circuit of FIG. 10, therefore, contains only two of the adjustable active elements of the circuit of FIG. 8, $C_1$ and $L_2$, which are functions of the distances $\theta_1$ and $\theta_2$, respectively. Varying the values of $\theta_1$ and $\theta_2$ from 0 through $\pi/2$ by the movement of bridging wires $18_1$ and $18_2$ will cause the tuner associated with FIG. 9 to be capable of matching exactly half of the impedance values falling within the Smith chart.

Figure 11:
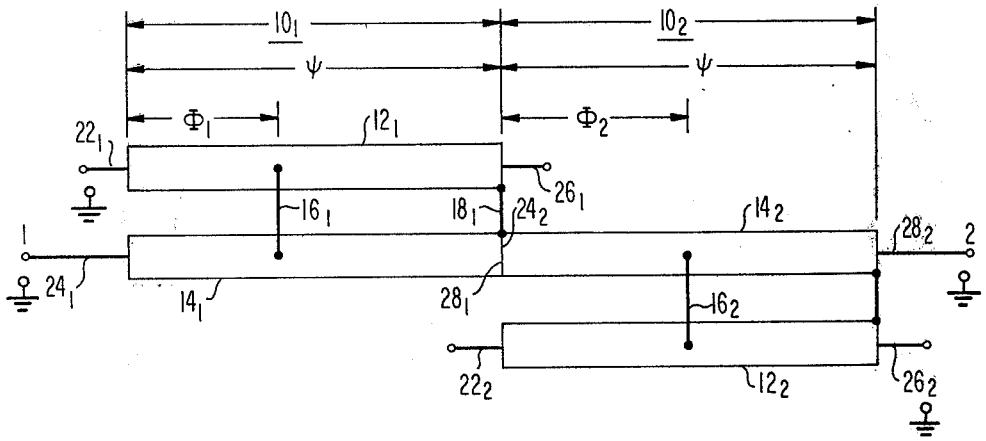
FIG. 11 illustrates another variant of the tuner of FIG. 6.

FIG. 11 illustrates another variant of the tuner of FIG. 6 where bridging wires $18_1$ and $18_2$ are positioned at the extreme right ends of tuning elements $10_1$ and $10_2$, respectively, thereby setting $\theta_1=\theta_2=0$. Therefore, under such conditions, only the movement of bridging wires $16_1$ and $16_2$ are capable of affecting the performance of the tuner.

Figure 12:
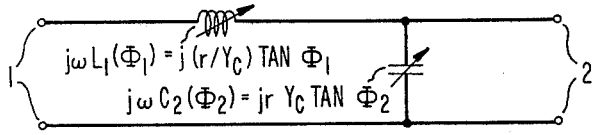
FIG. 12 illustrates a specific equivalent circuit of the tuner of FIG. 11 for the value of $\psi=\pi/2$.

FIG. 12 illustrates the equivalent circuit of the tuner of FIG. 11 for the value of $\psi=\pi/2$. This equivalent circuit is similar to the circuit of FIG. 8, where in this case $jrY_c \tan\theta_1=j\omega C_1=0$ and $j(r/Y_c) \tan\theta_2=j\omega L_2=0$, since $\theta_1=\theta_2=0$ as shown hereinabove in association with FIG. 11. The equivalent circuit of FIG. 12, therefore, contains only two of the adjustable active elements of the circuit of FIG. 8, $L_1$ and $C_2$, which are functions of $\Phi_1$ and $\Phi_2$, respectively. Varying the values of $\Phi_1$ and $\Phi_2$ from 0 thrpough $\pi/2$ by the movement of bridging wires $\mathbf{16}_1$ and $\mathbf{16}_2$ will cause the tuner of FIG. 11 to be capable of matching the impedances within the Smith chart not matched by the tuner of FIG. 9.

Figure 13:
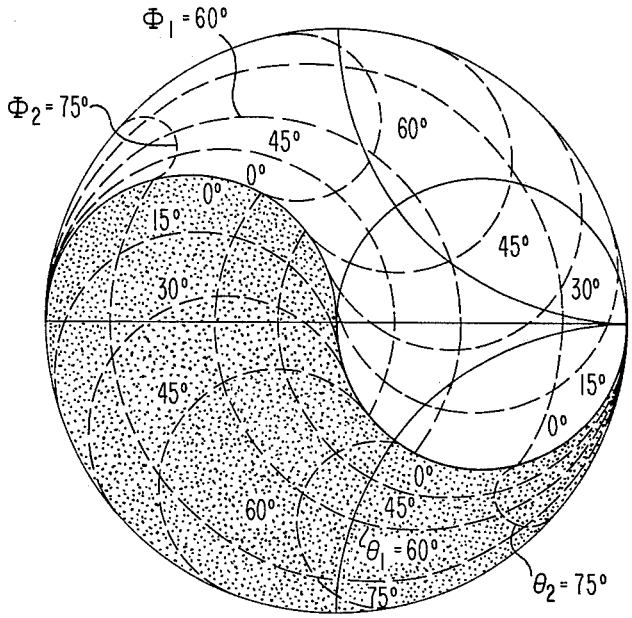
FIG. 13 illustrates the Smith chart coverage associated with the tuners of FIGS. 9–12.

FIG. 13 illustrates the Smith chart coverage referred to hereinabove in association with FIGS. 10 and 12. The darker half of the Smith chart is associated with the tuner of FIG. 9, and the lighter half of the Smith chart is associated with the tuner of FIG. 11. Therefore, the combined use of the pair of tuners of FIGS. 9 and 11 will be capable of matching any impedance falling within the Smith chart.

Figure 14:
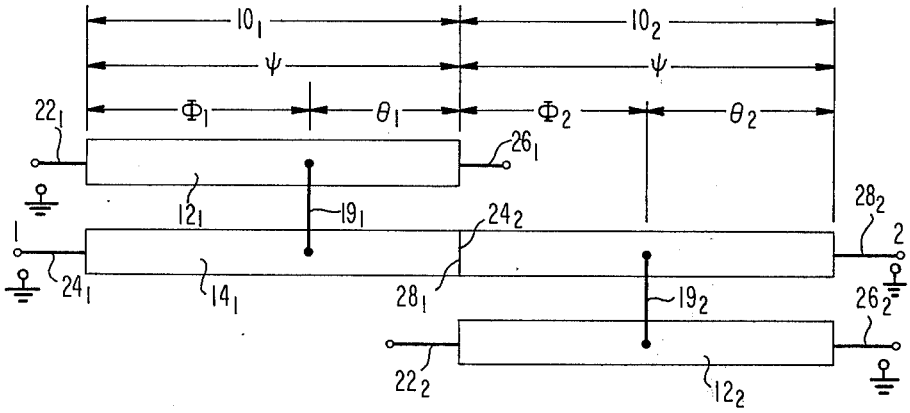
FIG. 14 illustrates another variant of the tuner of FIG. 6.

FIG. 14 illustrates another variant of the tuner of FIG. 6. In this case, bridging wires $\mathbf{16}_1$ and $\mathbf{18}_1$ are merged to form a single bridging wire $\mathbf{19}_1$, likewise, bridging wires $\mathbf{16}_2$ and $\mathbf{18}_2$ are merged to form a single bridging wire $\mathbf{19}_2$. The distances $\Phi_1$, $\theta_1$, $\Phi_2$ and $\theta_2$ are redefined as follows: $\Phi_1$ is defined as the electrical length measured between port $\mathbf{22}_1$ and bridging wire $\mathbf{19}_1$, calculated by using equation (1) where l is the physical length measured between port $\mathbf{22}_1$ and bridging wire $\mathbf{19}_1$. In a like manner, $\Phi_2$ is defined as the electrical length measured between port $\mathbf{22}_2$ and bridging wire $\mathbf{19}_2$, calculated by using equation (1) where l is the physical length measured between port $\mathbf{22}_2$ and bridging wire $\mathbf{19}_2$. The distance $\theta_1$ is defined as the electrical length measured between port $\mathbf{26}_1$ and bridging wire $\mathbf{19}_1$, calculated by using equation (1) where l is the physical length measured between port $\mathbf{26}_1$ and bridging wire $\mathbf{19}_1$. Likewise, the distance $\theta_2$ is defined as the electrical length measured between port $\mathbf{26}_2$ and bridging wire $\mathbf{19}_2$, calculated by using equation (1) where l is defined as the physical length measured between port $\mathbf{26}_2$ and bridging wire $\mathbf{19}_2$. The distances, as seen in FIG. 14 are interrelated as follows:

$$\Phi_1+\theta_1=\Phi_2+\theta_2=\Psi. \quad (6)$$

The interdependence of $\Phi_1$ and $\theta_1$, and of $\Phi_2$ and $\theta_2$ will be discussed in greater detail hereinafter in association with FIG. 15.

Figure 15:
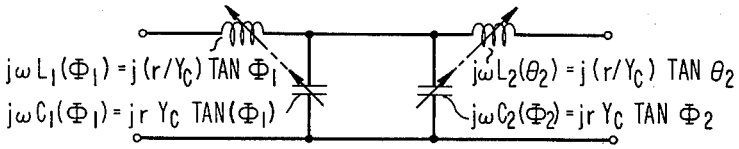
FIG. 15 illustrates a specific equivalent circuit of the tuner of FIG. 14 for the value of $\psi=\pi/2$.

FIG. 15 illustrates the equivalent circuit of the tuner of FIG. 14. The four adjustable active elements $L_1$, $C_1$, $L_2$ and $C_2$ are as described hereinabove in association with FIG. 8. In this case, however, the four elements are not independent, rather, $L_1$ and $C_1$ are interdependent and $L_2$ and $C_2$ are interdependent as shown by the dotted lines in FIG. 15. This interdependence can be determined by referring to FIG. 14, where increasing $\Phi_1$ can be seen to decrease $\theta_1$. Similarly, increasing $\Phi_2$ can be seen to decrease $\theta_2$. Therefore, the value of $L_1$, $j(r/Y_c) \tan\Phi_1$, varies inversely proportional to $C_1$, $jrY_c \tan\theta_1$. Similarly, the value of $L_2$, $j(r/Y_c) \tan\theta_2$, varies inversely proportional to $C_2$, $jrY_c \tan\Phi_2$. Due to this interrelationship, varying the placement of bridging wires $\mathbf{19}_1$ and $\mathbf{19}_2$ will cause the tuner of FIG. 14 to be capable of matching any impedance falling within the Smith chart.

It is to be understood that the above-described embodiments are simply illustrative of the principles of the invention. Various other modifications and changes may be made by those skilled in the art which will embody the principles of the invention and fall within the spirit and scope thereof.

I claim:

1. A strip transmission line circuit comprising a pair of tuning elements ($\mathbf{10}_1$, $\mathbf{10}_2$) disposed over a round plane, each tuning element comprising a first strip of conductive material (12) comprising first and second terminals disposed at separate ends of said first strip;

a second strip of conductive material (14) comprising first and second terminals disposed at separate ends of said second strip, said second strip equal in length to, and positioned in a parallel spaced-apart relationship with, said first strip to form a tuning element;

characterized in that the strip transmission line circuit further comprises the second terminal of the first strip of one of the pairs of tuning elements being connected to a first terminal of the first strip of the other of the pairs of tuning elements;

said connection defining a complementary interconnection of the pair of tuning elements, each tuning element further comprising at least one movable bridging wire (19) connecting the first and second strips, providing a shunt interconnection between said strips, said wire capable of moving along the entire length of said tuning element to provide a variable output impedance of said strip transmission line circuit.

2. A strip transmission line circuit in accordance with claim 1 characterized in that each tuning element further comprises a pair of movable bridging wires (16,18), each wire capable of moving along the entire length of said tuning element to provide a variable output impedance of the strip transmission line circuit.

* * * * *

UNITED STATES PATENT AND TRADEMARK OFFICE

CERTIFICATE OF CORRECTION

PATENT NO. : 4,267,532

DATED : May 12, 1981

INVENTOR(S) : Adel A. M. Saleh

It is certified that error appears in the above—identified patent and that said Letters Patent is hereby corrected as shown below:

Change the name of the Assignee from "W. L. Keefauver, Bell Laboratories, Murray Hill, N. J." to --Bell Telephone Laboratories, Incorporated, Murray, N. J.--.

Signed and Sealed this

*Twentieth* Day of *October 1981*

[SEAL]

*Attest:*

GERALD J. MOSSINGHOFF

*Attesting Officer*

*Commissioner of Patents and Trademarks*